US005671515A

United States Patent [19]

Evans

[11] Patent Number: 5,671,515

[45] Date of Patent: Sep. 30, 1997

[54] QUICK RELEASE CLASP

[76] Inventor: Michael D. Evans, 6728 Walnut Dr., Gates Mills, Ohio 44040

[21] Appl. No.: 630,486

[22] Filed: Apr. 10, 1996

[51] Int. Cl.[6] ..... A44B 21/00

[52] U.S. Cl. ..... 24/615; 24/521

[58] Field of Search ..... 24/615, 614, 604, 24/588, 662, 666, 667, 3.1, 7, 3.12, 322.1, 323, 324

[56] References Cited

U.S. PATENT DOCUMENTS

| | | | |
|---|---|---|---|
| D. 310,448 | 9/1990 | Scognamillo et al. | D3/61 |
| 3,798,711 | 3/1974 | Cousins | 24/323 |
| 4,398,324 | 8/1983 | Bakker et al. | 24/615 X |
| 4,866,819 | 9/1989 | Kasai | 24/614 |
| 4,901,406 | 2/1990 | Shelby et al. | 24/521 |
| 4,977,650 | 12/1990 | Ida | 24/614 |
| 5,263,234 | 11/1993 | Fudaki | 24/615 X |
| 5,318,292 | 6/1994 | De Marco | 24/501 X |
| 5,319,836 | 6/1994 | Ida | 24/614 X |
| 5,471,716 | 12/1995 | Takahashi | 24/615 |
| 5,535,485 | 7/1996 | Kirchner | 24/614 X |
| 5,537,725 | 7/1996 | Takahashi | 24/615 |
| 5,551,131 | 9/1996 | Anscher | 24/614 |

OTHER PUBLICATIONS

"Buckle Up Detachable Key Carrier" brochure, SynerMar, 1 page, undated.

*Primary Examiner*—Jose V. Chen
*Assistant Examiner*—Robert J. Sandy
*Attorney, Agent, or Firm*—Renner, Kenner, Greive, Bobak, Taylor & Weber

[57] ABSTRACT

A clasp (10) for connecting two items includes two interconnecting members (11, 12). One member (11) utilizes a rivet (14) to engage one of the items, for example, a golf towel (23). That member (11) also has a receiver (24) formed therein which has a slot (25). The other member (12) has a tab (28) with a flexible button (30) extending upwardly therefrom. The tab (28) is received in the slot (25) until the button (30) snaps up through an aperture (21) in the cover (18) of the receiver (24). The members (11, 12) are thus attached to each other but the attachment can be disengaged merely by depressing the button (30) and sliding the tab (28) out of the slot (25). The other end of the member (12) has a foldable flap (26) which can be formed into a loop (40) to engage another item, for example, a portion (39) of a golf bag.

6 Claims, 3 Drawing Sheets

QUICK RELEASE CLASP

TECHNICAL FIELD

This invention relates to a clasp for at least temporarily attaching two items together. More particularly, this invention relates to such a clasp which can quickly be released or opened to separate the two items and just as quickly latched or closed to join the two items.

BACKGROUND ART

A wide variety of buckles or clasps are known in the art and are found, for example, on belts, jewelry, pet collars and the like. In short, such clasps are often used whenever two items are to be at times joined together and at other times to be separated. In many instances, out of necessity, if not expediency, it is desirable to provide a clasp which can be activated or released quickly. Of course, such must be carefully designed so that they cannot be accidentally activated.

Such clasps are particularly needed where an item that is stored at one location is often desired to be quickly removed from its stored location and taken to another location. Typical of such situations would be an item such as a golf towel which is often stored on or otherwise attached to an item such as a golf bag for easy removal therefrom. Golfers are known to carry towels for cleaning their golf clubs and/or golf balls and most often such towels are in some manner attached to the golf bag. At times, the golfer will want to quickly remove the towel from the bag to carry it with him, for example, onto a golf green, but presently known means of attaching the towel to the bag do not provide both, on one hand, a secure attachment so that the towel is not lost, and on the other hand, a means by which the towel can be quickly released from the bag.

Most often, towels are attached to bags utilizing items such as shower hooks, key chains, or other similar hardware which can be difficult to manipulate quickly as is often desired by the golfer frequently during a round of golf. Thus, the need exists for a clasp, for use both in the field of golf equipment and elsewhere, which is easy to manufacture and assemble and which can quickly join two items together or be activated to separate the two items.

DISCLOSURE OF THE INVENTION

It is thus an object of the present invention to provide a clasp that can securely join two items together while at the same time be quickly activated to release the two items from each other.

It is another object of the present invention to provide a clasp, as above, which is inexpensive to manufacture and easy to assemble.

It is a further object of the present invention to provide a clasp, as above, which is especially suited to attach a golf towel to a golf bag.

It is an additional object of the present invention to provide a clasp, as above, which is formed of two interengaging portions, one portion of which can be attached to an item, such as a golf towel, while that portion is being assembled, and the other portion of which can be attached to another item, such as a golf bag, while that portion is being assembled.

These and other objects of the present invention, as well as the advantages thereof over existing prior art forms, which will become apparent from the description to follow, are accomplished by the invention hereinafter described and claimed.

In general, a clasp made in accordance with the concepts of the present invention for attaching a first item to a second item includes a first member having one end adapted to be attached to the first item. A second member has one end adapted to be attached to the second item. The other end of one of the members is configured as a receiver while the other end of the other of the members is configured as a tab. The tab is adapted to slide within and releasedly engage the receiver to attach the first item to the second item.

A preferred exemplary clasp incorporating the concepts of the present invention is shown by way of example in the accompanying drawings without attempting to show all the various forms and modifications in which the invention might be embodied, the invention being measured by the appended claims and not be the details of the specification.

PREFERRED EMBODIMENT FOR CARRYING OUT THE INVENTION

Figure 7:
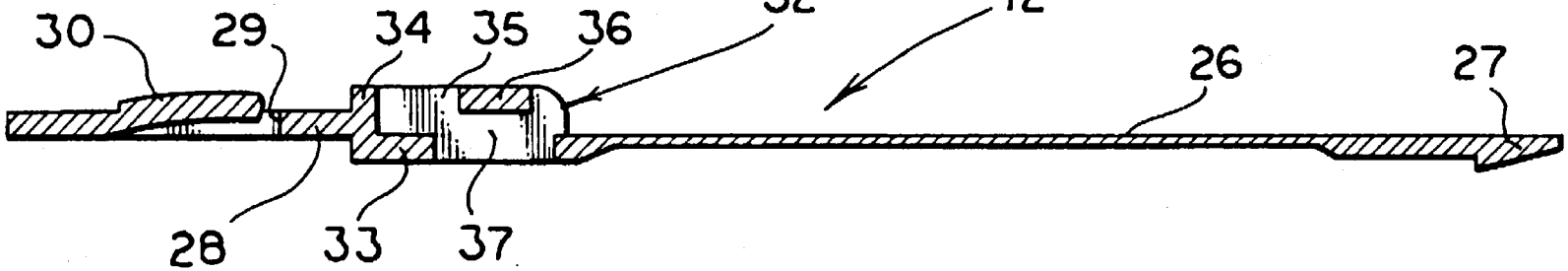
FIG. 7 is a sectional view of the portion of the clasp shown in FIGS. 5 and 6 showing its condition prior to being assembled and attached to the item.
Figure 8:
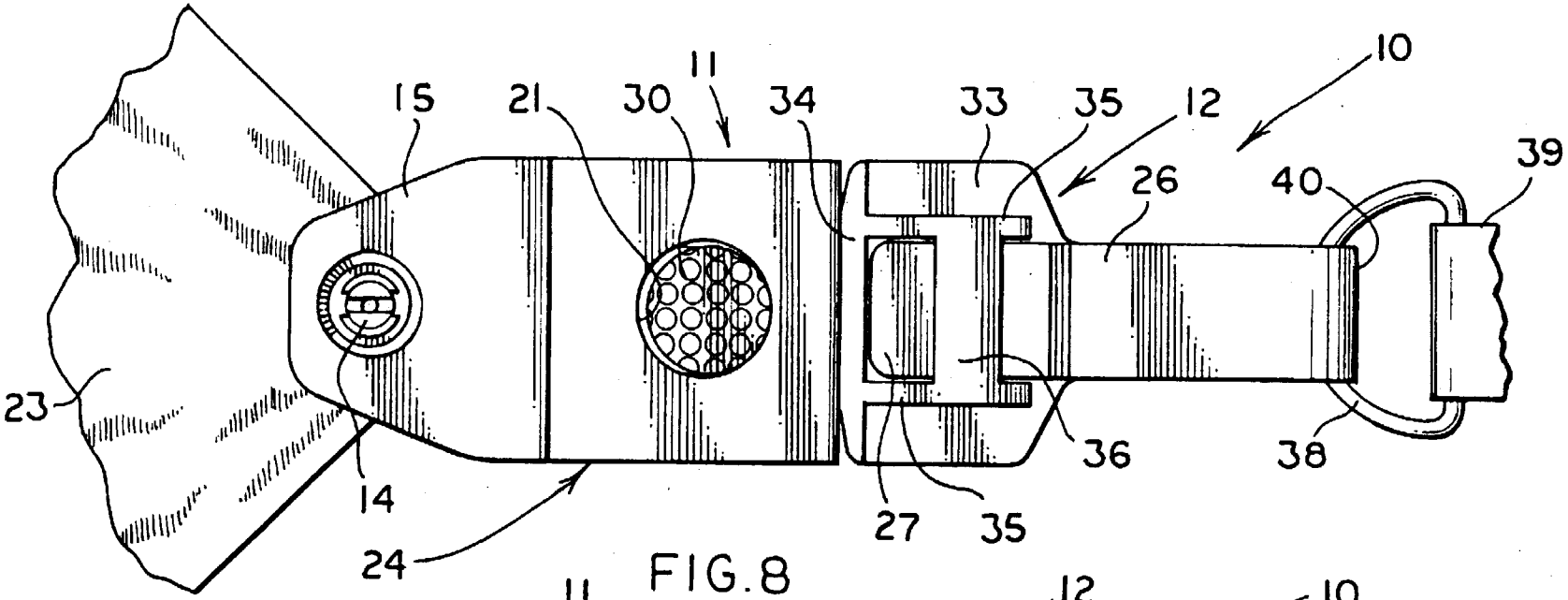
FIG. 8 is a top plan view of an assembled clasp showing the portion of FIG. 5 engaging the portion of FIG. 1.
Figure 9:
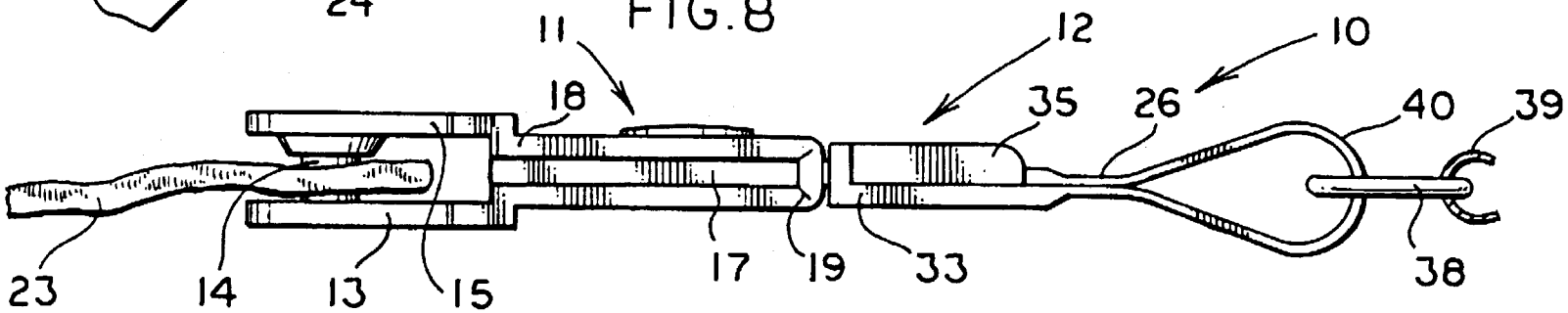
FIG. 9 is a side elevational view of the assembled clasp of FIG. 8.

An assembled clasp made in accordance with the concepts of the present invention is shown in FIGS. 8 and 9 and is indicated generally by the numeral 10. Clasp 10 includes two interconnecting members or portions, one such member being shown in FIGS. 1–4 and generally indicated by the numeral 11 and the other member being shown in FIGS. 5–7 and generally indicated by the numeral 12. Members 11 and 12 can be made out of any suitable rigid, but somewhat resilient, plastic material such as nylon polypropylene.

Figure 3:
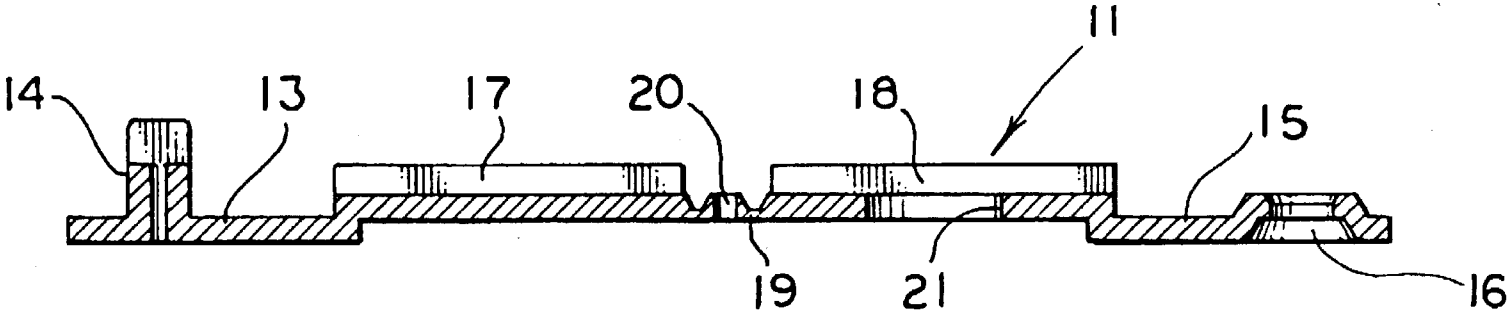
FIG. 3 is a sectional view of the portion of the clasp shown in FIGS. 1 and 2 showing its condition prior to being assembled and attached to the item.
Figure 4:
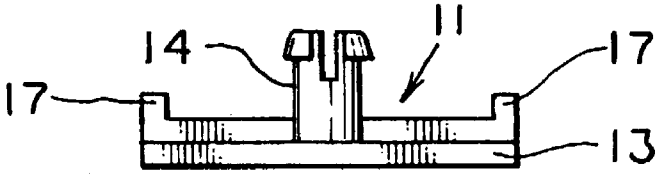
FIG. 4 is an end elevational view of the portion of the clasp shown in FIG. 3.

As shown in FIG. 3, member 11 is first formed as a generally flat strip of such plastic material with one end thereof having a lip 13 which carries an upstanding, split, locking rivet 14, and the other end having a lip 15 which is provided with a rivet-receiving aperture 16 therethrough. Inwardly adjacent to lip 13 is a platform 17 and inwardly adjacent to lip 15 is a cover 18. Platform 17 is connected to cover 18 as by a living hinge 19 which has a slot aperture 20 therethrough. Cover 18 is also provided with a preferably circular aperture 21 therethrough.

Member 11 is adapted to carry an item that is to be removed from normal storage on another, more permanently positioned, item. For example, member 11 may carry a golf towel 23 but is certainly not limited to that application. For example, member 11 could carry a tool, keys or the like which may be held by clasp 10 on a wall. In short, member 11 can be adapted to carry any item which is being temporarily stored at one location, as a golf towel is carried by a bag or a tool is hung on a wall, with the intention that it be quickly removable from that stored location. Thus, when reference is made herein to golf towel 23, it is to be understood that such is merely representative of a myriad of items which could be carried by member 11.

Figure 1:
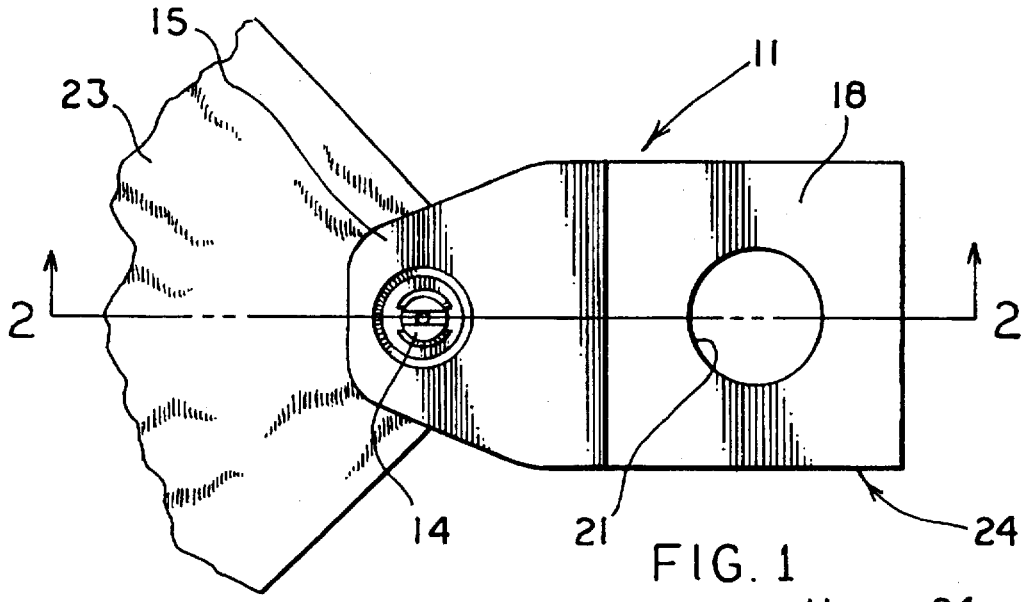
FIG. 1 is a top plan view of one portion of a clasp made in accordance with the concepts of the present invention and shown as carrying an item such as a golfer's towel.
Figure 2:
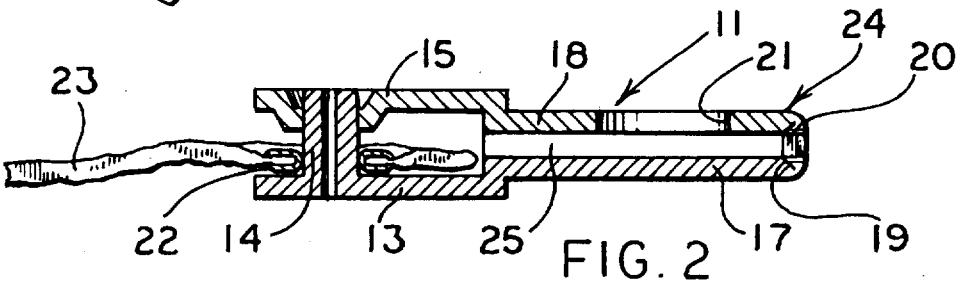
FIG. 2 is a sectional view of the portion of the clasp shown in FIG. 1 taken substantially along line 2—2 of FIG. 1.

Towel 23 can be provided with a grommet 22 that is received over rivet 14, as shown in FIG. 3, to thereby attach towel 23 to member 11. Member 11 may then be folded on hinge 19 and aperture 16 snapped over rivet 14 which holds member 11 in the folded, FIG. 2 position. Thus, as shown in FIG. 2, member 11 holds towel 23 on rivet 14 and between opposed lips 13, 15. In addition, if desired, when folded, cover 18 may snap into position adjacent to platform 17. Also when folded, cover 18 is opposed to platform 17 and forms a receiver, generally indicated by the numeral 24, which has a slot 25 therein defined by the space between cover 18 and platform 17. Access to slot 25 is gained through aperture 20.

Figure 5:
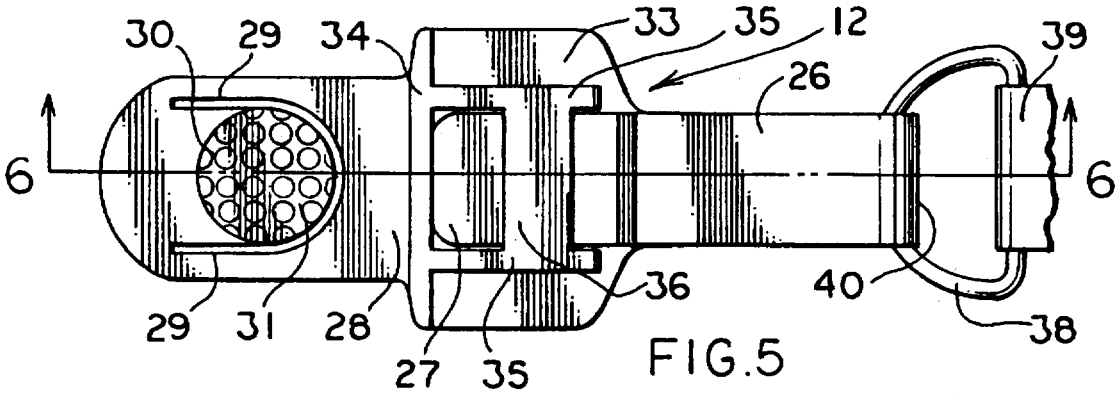
FIG. 5 is a top plan view of the other portion of the clasp made in accordance with the concepts of the present invention and shown as being carried by an item such as a ring on a golf bag.

As shown in FIG. 7, the other member 12 of clasp 10 is also first formed as a generally flat strip of plastic material with one end thereof being formed as a thin, elongate flap 26 having a ramped lock barb 27 at the outer end thereof. The other end of member 12 is formed as a tab 28 which is provided with a U-shaped cut 29 therein. The resilient plastic within cut 29 is deformed or bent to form a lock button 30 that normally extends upwardly above the upper surface of tab 28. As shown in FIG. 5, for example, the circular upper surface of button 30 may be provided with a texture or pattern 31 to assist in the frictional engagement of button 30 to be hereinafter described.

A body member 32 of portion 12 of clasp 10 carries tab 28 on one side thereof and flap 26 on the other side thereof. Body member 32 includes a horizontal platform 33 which carries flap 26 and a wall 34 extending upwardly from platform 33 which carries tab 28. Also extending upwardly from platform 33 and laterally of wall 34 are spaced guide rails 35. A lock bar 36 extends between the upper edges of rails 35 and is spaced from platform 33, as at 37.

Figure 6:
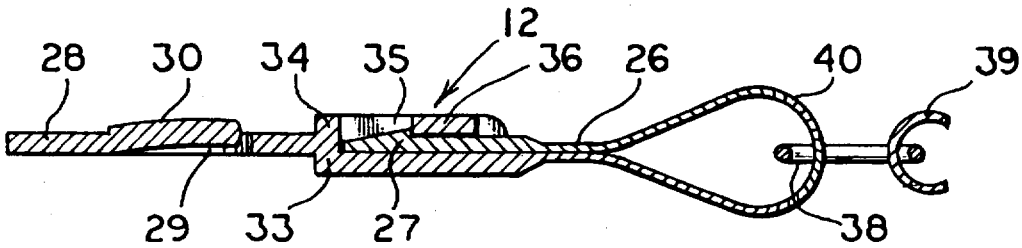
FIG. 6 is a sectional view of the portion of the clasp shown in FIG. 5 taken substantially along line 6—6 of FIG. 5.

Member 12 is adapted to be attached to some item, such as a D-ring 38 carried by a portion 39 of a golf bag, by threading flap 26 through the D-ring 38 and bending flap 26 back over itself, as shown in FIGS. 5 and 6, to form a loop 40. Ramped lock barb 27 is then slid in the space 37 below lock bar 36 and between rails 35 until it engages bar 36 as shown in FIG. 6. Thus, member 12 is attachable to D-ring 38 or any other item, as previously discussed. While such attachment is intended to be reasonably permanent in nature, it should be evident that lock barb 27 can be disengaged from bar 36 to open loop 40, as may be desired.

Clasp portion or member 12 is attachable to clasp portion or member 11 merely by sliding tab 28 through opening 20 and into slot 25 of receiver 24. During such action, cover 18 will depress button 30 which will eventually snap up and through circular aperture 21. At this time, members 11 and 12 will be engaged as shown in FIGS. 8 and 9. As such, the items that they are carrying will be connected, for example, towel 23 will be carried by bag 39. To disengage members 11 and 12, the textured area 31 of button 30 need only be depressed slightly and tab 28 can be slid out of receiver 24.

It should thus be evident that a clasp constructed as described herein accomplishes the objects of the present invention and otherwise substantially improves the art.

What is claimed is:

1. Apparatus for releasably attaching a first item to a second item comprising a first member having one end adapted to be attached to the first item, a second member having one end adapted to be attached to the second item, a receiver positioned at the other end of one of said members, said receiver including a cover and a platform spaced from said cover thereby forming a slot in the space between said cover and said platform, said receiver also including a hinge connecting said cover and said platform, and an aperture at said hinge so that said tab may be received through said aperture and into said slot, and a tab extending outwardly from the other end of the other of said members, said tab being adapted to slide within and releasably engage said receiver.

2. Apparatus according to claim 1, said first member having a rivet at said one end, the first item being attachable to said rivet.

3. Apparatus for releasably attaching a first item to a second item comprising a first member having a rivet at one end adapted to be attached to the first item, a first lip carrying said rivet, a second lip having a rivet engaging aperture, and a hinge between said first and second lips such that when said first member is folded on said hinge, said rivet engaging aperture is received by said rivet and the first item is held by said rivet and between said first and second lips, a second member having one end adapted to be attached to the second item, a receiver positioned at the other end of one of said members, and a tab extending outwardly from the other end of the other of said members, said tab being adapted to slide within and releasably engage said receiver.

4. Apparatus for releasably attaching a first item to a second item comprising a first member having one end adapted to be attached to the first item, a second member having one end adapted to be attached to the second item, a receiver positioned at the other end of one of said members, a tab extending outwardly from the other end of the other of said members, said tab being adapted to slide within and releasably engage said receiver, a body member on said other of said members, said tab extending outwardly from one side of said body member, and a flap for engaging said second item extending outwardly from the other side of said body member.

5. Apparatus according to claim 4 wherein said flap is flexible and foldable back on itself to have its outer end engaged by said body member thereby forming a loop to engage said second item.

6. Apparatus according to claim 5 wherein said body member includes guide rails and a lock bar extending therebetween, said outer end of said flap having a barb thereon such that when said flap is slid between said guide rails and under said lock bar, said barb will engage said lock bar.

* * * * *